United States Patent [19]

Gelbard et al.

[11] 4,156,352

[45] May 29, 1979

[54] COOLING ARRANGEMENT FOR A REFRIGERATOR MACHINERY COMPARTMENT

[75] Inventors: Robert B. Gelbard; Ronald D. Gregg, both of Louisville, Ky.

[73] Assignee: General Electric Company, Louisville, Ky.

[21] Appl. No.: 853,355

[22] Filed: Nov. 21, 1977

[51] Int. Cl.[2] ..... F25D 21/14; F25D 19/00; F25B 39/04

[52] U.S. Cl. ..... 62/285; 62/295; 62/455; 62/507

[58] Field of Search ..... 62/183, 285, 454, 455, 62/507

[56] References Cited

U.S. PATENT DOCUMENTS

| | | | |
|---|---|---|---|
| 1,281,027 | 10/1918 | Kramer | 62/507 |
| 2,011,078 | 8/1935 | Replogle | 62/295 |
| 2,723,533 | 7/1952 | Mann | 62/455 |
| 3,736,768 | 6/1973 | Harbour et al. | 62/455 |
| 3,785,168 | 1/1974 | Domingorene | 62/285 |

*Primary Examiner*—Lloyd L. King

*Attorney, Agent, or Firm*—Radford M. Reams; Frederick P. Weidner

[57] ABSTRACT

A refrigerator has a machinery compartment at the bottom for housing a motor-compressor unit and a condenser and has an air inlet opening at the front thereof extending substantially across the width of the compartment. The machinery compartment includes a forward section for receiving the condenser and a duct at the rear portion thereof for receiving the motor-compressor unit. The duct has an air inlet at one end for receiving air from the forward section. The condenser extends generally horizontally from one side wall of the compartment across a substantial portion of the forward section. A drain pan is supported above the condenser for collecting water draining from the interior of the refrigerator. The drain pan additionally functions as a baffle to cause air entering the forward section to flow effectively over the condenser. A fan is positioned at the inlet of the duct and the motor-compressor unit is so positioned in the duct that the compressor portion thereof is positioned adjacent to the fan so that substantially all of the air discharged from the fan is directed onto the compressor portion, thereby maximizing the heat transferred from the compressor to the air flowing through the compartment.

7 Claims, 2 Drawing Figures

COOLING ARRANGEMENT FOR A REFRIGERATOR MACHINERY COMPARTMENT

BACKGROUND OF THE INVENTION

The present invention relates generally to refrigerators and more particularly to a forced air cooling arrangement for the machinery compartment of a refrigerator.

In many modern refrigerators a motor-compressor and a condenser are mounted in a machinery compartment at the bottom of a cabinet and a fan is provided for circulating air through the compartment. The primary concern with respect to the air flow through the compartment has been directed to moving a high volume of air over the condenser and to also move a portion of the air over the motor-compressor to transfer heat during operation. In the usual arrangement, the machinery compartment is divided into two side-by-side sections by means of a longitudinally extending partition running generally from the front of the compartment to the rear wall and having a fan mounted in the rear portion of the partition. A motor-compressor unit and a condenser are mounted in one section of the compartment and a defrost water drain pan is positioned in the other section of the compartment. The fan draws a stream of air inwardly through a front opening in one section over the condenser and compressor and discharges the air into the other section over the drain pan and primarily out the front of this section of the compartment. With this arrangement the volume of air flow over the compressor is reduced due to the restrictions and diffusion of air flow imposed by the condenser. Further, the air-borne grease, lint and dust particles picked up in the air which are drawn into the machinery compartment eventually block the upstream face of the condenser and further reduce the air flow which reaches the compressor. The clogging of the condenser results in both an excessive rise in condenser temperature and reduced flow over the compressor, producing elevated compressor temperatures.

Another arrangement is shown in U.S. Pat. No. 3,785,168 to Domingorene, having a transverse fan which draws air across a condenser then over a portion of the motor-compressor with the discharge of the fan directing air out of an outlet. Another machinery compartment arrangement as shown in U.S. Pat. No. 1,281,027 to Kramer discloses a vertical coiled condenser, a compressor and an axial fan in series. The fan draws air across the condenser and then across a compressor, with the discharge of the fan directed to an air outlet.

The condenser used in the above-described cooling arrangement usually comprise a stack of coiled or serpentine refrigerant tubing provided with a plurality of closely spaced wire or plate-type fins. The serpentine tubing is folded to form two or more superimposed sections or tiers in order to provide the required heat transfer surface within the volume provided by the machinery compartment. As previously discussed, a problem with such forced air machinery compartments has been the accumulation of dust and other foreign substances on the condenser which acts as insulation and materially lowers the condenser efficiency. The coiled condensers and the multi-layered condenser arrangements tend to restrict the flow of air over the condenser and tend to provide traps which clog with the dust and other foreign particles. This dust further restricts air flow and requires that the condensers must periodically be cleaned.

An arrangement shown in U.S. Pat. No. 3,736,768 to Harbour et al recognizes that performance could be improved by directing air directly against the motor-compressor unit. Although the patent to Harbour et al discusses air flow against what is referred to as a compressor, the usual motor-compressor unit (item 24 of Harbour et al) is shown with no indication where the compressor portion of the motor-compressor is located relative to the air flow. Aside from Harbour et al's failure to recognize that performance could be improved by positioning the compressor portion of the motor-compressor unit adjacent the fan so as to be directly subjected to air discharged by the fan, Harbour et al disclose no cooling arrangement which optimizes the shape and position of the condenser and the air flow through the machinery compartment to maximize performance while minimizing manufacturing costs.

Accordingly, one object of the present invention is to provide an arrangement for air flow through the machinery compartment which improves removal of heat from the compressor.

Another object of the invention is to provide a cooling arrangement for a machinery compartment of a refrigerator which cooling arrangement reduces collection of dust on the condenser and essentially eliminates any requirement for cleaning the condenser during the life of the refrigerator.

Another object is to provide an arrangement for air flow through the machinery compartment which permits a reduction of condenser size with no loss of refrigeration performance.

Another object is to make use of a drain pan for the additional purpose of causing more effective air flow over the condenser.

Still a further object of the present invention is to provide a cooling arrangement for a machinery compartment which permits a low profile of the refrigerator cabinet.

SUMMARY OF THE INVENTION

The invention is directed to a cooling arrangement for a motor-compressor unit and a condenser of a refrigerator. The refrigerator has a machinery compartment at the bottom for housing the motor-compressor unit and the condenser and has an air inlet opening at the front thereof extending substantially across the width of the compartment. The machinery compartment has a forward section for receiving the condenser and has a duct at the rear portion thereof for receiving the motor-compressor unit. The duct has an air inlet at one end within the compartment for receiving air from the forward section and has an outlet for exhausting air out of the compartment. The condenser extends generally horizontally from one side wall of the compartment across a substantial portion of the forward section. A generally flat rectangular shallow drain pan is supported above the condenser for collecting water draining from the interior of the refrigerator. The drain pan additionally functions as a baffle to cause air entering the section to flow effectively over the condenser. The duct includes a first generally vertical forward partition positioned generally parallel with the rear wall between a top wall and a bottom wall and extending from one side wall of the compartment to an approximate mid-compartment location adjacent the inlet of the duct. This generally vertical partition of the duct is positioned at the rear of the condenser and thereby also directs the air to flow transversely across the rear portion of the condenser. A second generally vertical partition is interposed between the condenser and the other side wall of the machinery compartment for directing air to flow over the condenser and preventing air flow in that region from bypassing the condenser. The first partition, the second partition and the drain pan provide balanced impedance and deflection of the entering air whereby the air flow entering the forward section of the compartment is substantially evenly distributed over the entire condenser. A fan is positioned at the inlet of the duct. The motor-compressor unit is positioned in the duct. In accordance with this invention the compressor portion of the motor-compressor unit is positioned so that it is adjacent to the fan. The fan draws air over the condenser to the inlet of the duct and, because of the position of the compressor portion, substantially all of the air discharged from the fan is directed onto the compressor portion, thereby maximizing the heat transferred from the compressor by the flow of air through the machinery compartment. The increased heat transfer as a result of the more effective cooling of the compressor permits the use of a smaller condenser. The reduction in size of the condenser permits the condenser to be arranged within the available space in substantially a single layer, thereby facilitating the flow of air through the compartment and also minimizing the collection of dust on the condenser.

BRIEF DESCRIPTION OF THE DRAWINGS

While the novel features of the invention are set forth with particularity in the appended claims, the invention will be better understood along with other features thereof from the following detailed description taken in conjunction with the drawings in which:

DESCRIPTION OF THE PREFERRED EMBODIMENT

Figure 1:
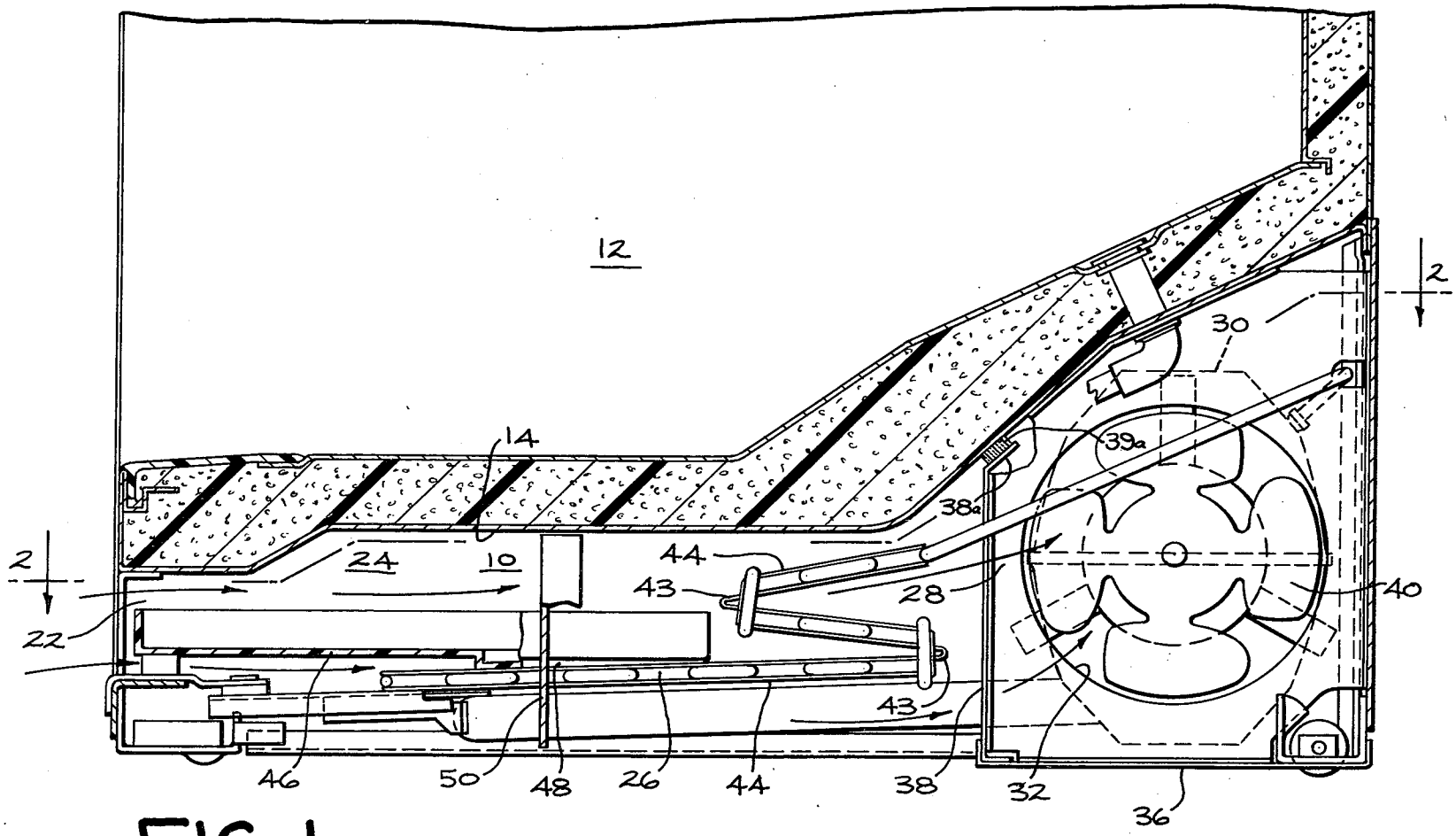
FIG. 1 is a vertical sectional view of a portion of a refrigerator showing the machinery compartment cooling arrangement of this invention.
Figure 2:
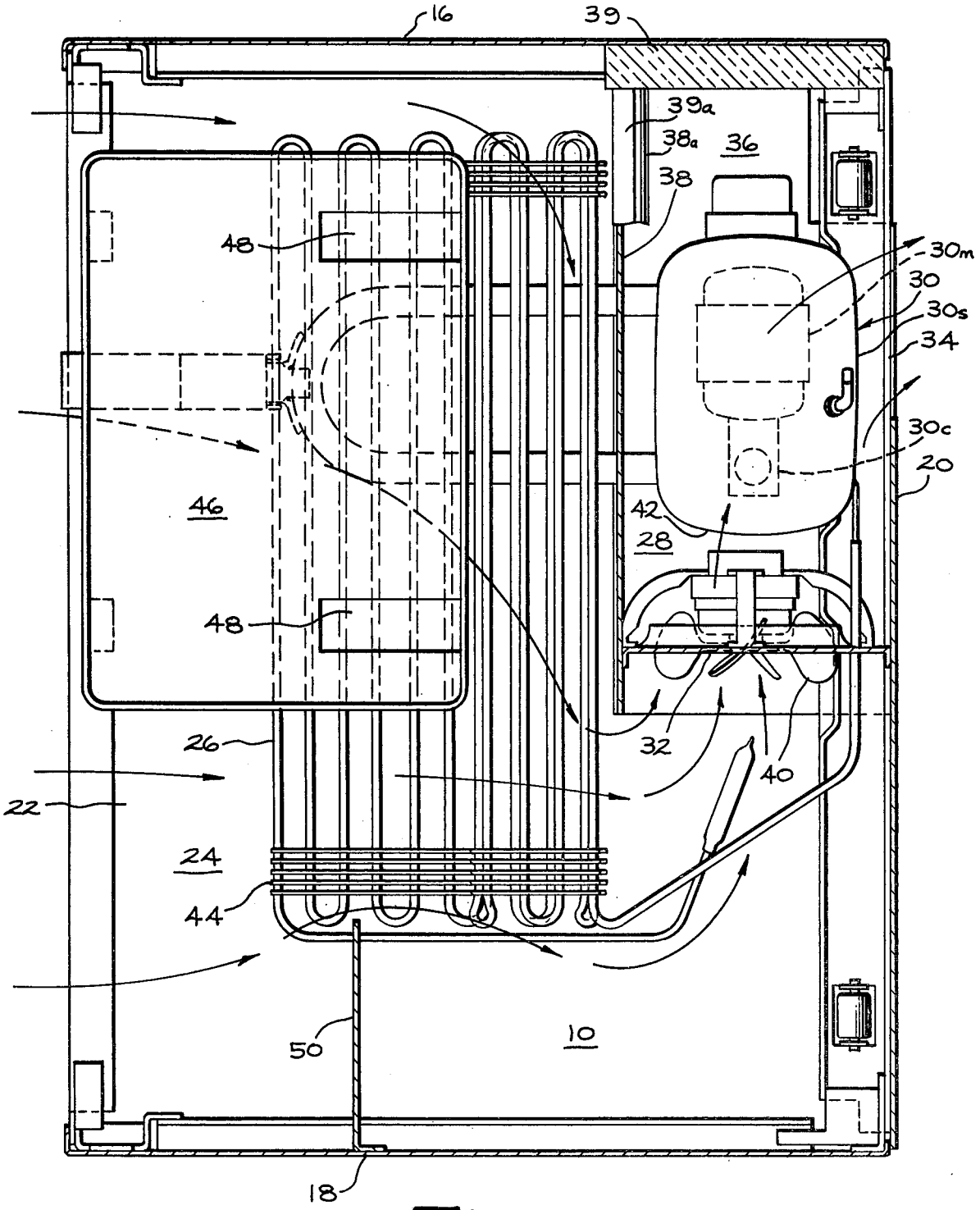
FIG. 2 is a sectional view taken along the line 2—2 in FIG. 1.

With reference to the accompanying drawings, there is shown a portion of household refrigerator including a machinery compartment 10 in the lower portion of the cabinet. This compartment is separated from a refrigerated storage compartment 12 by an insulated wall 14 forming the top wall of the machinery compartment. The compartment 10 is further defined by side walls 16 and 18 of the cabinet and a rear wall 20 and has an air inlet opening 22 at the front thereof. The opening 22 extends substantially the full width of the compartment and is usually provided with a decorative grill (not shown).

In accordance with the present invention, the machinery compartment 10 has a forward section 24 at the front portion thereof for receiving a condenser 26. Compartment 10 also includes a transverse duct 28 at the rear portion thereof for receiving a motor-compressor unit 30. The motor-compressor unit includes an electric motor **30*m* driving compressor 30*c*, both enclosed within a hermetically-sealed outer shell 30*s*. Duct 28 has an air inlet 32 at one end within compartment 10 for receiving air from forward section 24 and has an outlet 34 for exhausting air from the compartment. The outlet 34 is empirically sized and positioned for optimum airflow distribution over the motor-compressor unit 30**.

Duct 28 is defined by a portion of rear wall 20, a portion of side wall 16, a portion of top wall 14 and has a substantially horizontal bottom wall 36 and has a forward wall formed by a first generally vertical partition 38. For sound deadening and for air sealing, a slab 39 of sealing material such as glass fiber material may be placed against a portion of the wall 16, in sealing engagement with the partition 38. The vertical partition 38 is positioned generally parallel with rear wall 20 between top wall 14 and bottom wall 36, and extends from side wall 16 to an approximately mid-compartment location adjacent air inlet 32. A strip **39*a* of sealing is placed between the top wall 14 and the upper flange 38*a* of the partition 38. Air inlet 32 is positioned generally vertical and perpendicular to rear wall 20**.

A fan 40 is positioned at inlet 32 of duct 28. Motor-compressor unit 30 is disposed in duct 28 with the compressor end or portion 42 of the shell **30*s* positioned adjacent fan 40. Fan 40 draws air through opening 22 over condenser 26 to inlet 32. The fan 40 then directs substantially all of the discharged air over the compressor portion 42, thereby maximizing heat transfer from the compressor 30*c* to the air flowing through the compartment 10**.

There are two advantages to this increased transfer of heat from the compressor **30*c*** to the airflow. Firstly, the benefits of compressor intercooling are achieved in part. As is known in the art of compressors, isothermal compression, which may be approached by cooling the gas a it undergoes compression, is more efficient than adiabatic compression. Thus overall, the refrigeration system operates more efficiently when heat is removed from the compressor. Secondly, when a portion of the heat is removed from the compressor, less remains to be removed from the condenser. A smaller condenser may therefore be employed.

Calorimeter studies and performance test data show that the above arrangement of this invention permits the condenser to be approximately 15 to 20% smaller in size while maintaining the equivalent performance of the refrigerating system. In addition to the obvious reduction in manufacturing costs of refrigerant tubing and wire, the smaller condenser requirement allows the size and shape of the condenser to be more efficiently adapted to the machinery compartment and to be constructed in a manner which reduces collection of dust and other foreign matter on the condenser.

Thus, because of the reduction is required condenser capacity, the condenser 26 is arranged substantially in a single layer of serpentine refrigerant tubing having closely spaced wires 44 providing additional heat transfer area extending along the upper and lower surfaces. The condenser 26 extends horizontally within a substantial portion of section 24. FIG. 1 shows two slight folds 43 at the rear of the condenser in this particular embodiment. This is necessary for the particular size refrigerator and the available space in section 24. However, in accordance with the invention, in many models where smaller refrigerating capacity is required or greater transverse width of condenser is employed, the condenser can be fitted into the section 24 in a flat configuration wherein a flat vertical or inclined rear portion replaces the folds 43 to thereby further reduce dust collection. The configuration of the condenser readily allows air to flow over the surface providing a high rate of heat transfer. The relatively simple configuration also provides little opportunity for dust and other foreign particles to become clogged in the structure, since the foreign particles can readily fall through the condenser or be blown free by the stream of air passing over the condenser. A dust test is routinely conducted during the performance evaluation of refrigerators manufactured by the assignee and involves the application of a large quantity of dust, grease and lint into the machinery compartment over an extended period of time while monitoring performance and motor run winding temperatures of the refrigerator. Refrigerators having machinery compartments of the prior art configurations typically required that the condensers be cleaned after a test exposure duration which correlated to five years of service. However, equivalent refrigerators having machinery compartment arrangements in accordance with the present invention performed satisfactorily through a test exposure duration which correlated to a service life in excess of 20 years without requiring that the condenser be cleaned.

A drain pan 46 is normally employed to receive defrost water accumulating during the normal operation of the refrigerator. The drain pan is commonly located in the machinery compartment to utilize the available heat and air flow to evaporate the water collected to the pan. In the arrangement disclosed in this application, the drain pan is employed to provide a significant additional function, namely, directing the air flow over the condenser. The drain pan 46 is in the form of a generally flat, rectangular shallow pan and is supported on the condenser 26 by supports 48 which space the pan slightly from the upper surface of the condenser. Because of its position within the machinery compartment relative to the condenser the pan 46 deflects air entering section 24 and causes the air to flow under the pan and over the condenser 26 toward the rear of the condenser.

The first partition 38 forms the forward wall of duct 28 and is positioned at the rear of condenser 26 extending from side wall 16. The first partition 38 directs air flow transversely across the rear of the condenser.

In order to facilitate maximum air flow over the condenser 26, a second vertical partition 50 is interposed between the condenser and side wall 18 of machinery compartment 10. Partition 50 causes air entering section 24 to flow over the condenser and prevents the air from bypassing the condenser. The partition 50 is normally required where the condenser 26 is not coextensive with the width of the machinery compartment. Ideally, the condenser 26 would extend the full width of section 24; however, manufacturing limitations often preclude use of the ideal arrangement and therefore partition 50 is usually required.

The drain pan 46, the first partition 38 and the second partition 50 are so positioned and sized so that they provide balanced impedance and deflection of the air entering section 24 whereby air drawn through the forward section is distributed in a substantially even flow over the entire condenser surface. It will be appreciated that empirical adjustment of the dimensions of the various elements, particularly the length of the partition 50, is required to achieve a balanced air flow condition in each particular refrigerator model.

The compact configuration of the condenser 26, along with the arrangement which facilitates efficient air flow over the condenser, provides additional advantages for the performance and manufacture of the refrigerator. One such advantage is that the vertical height of machinery compartment 10 can be reduced. This provides a refrigerator having a lower profile with more usable space for the customer.

Another advantage of the arrangement of this invention is that the amount of machinery compartment noise can be reduced. The compact condenser provides more available space for adding sound-proofing material. Also, the primary sources of refrigerator noise are the motor-compressor unit and the fan which, in accordance with this invention, are confined to the duct 28. The duct itself tends to separate the noise sources from the front of the cabinet. Additionally, a dust extension 52 at the inlet 32 surrounds and projects beyond the fan 40 and serves to substantially reduce fan tip noise. The walls of the duct may be covered by sound-proofing material to further reduce noise levels of the refrigerator.

While a specific embodiment of the present invention has been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. In a refrigerator having a machinery compartment at the bottom for housing a motor-compressor unit and a condenser, with an air opening at the front of the machinery compartment extending substantially the full width of the compartment, a cooling arrangement for the motor-compressor unit and the condenser comprising:

the machinery compartment having a forward section at the front portion thereof for receiving said condenser and having a duct at the rear portion thereof for receiving said motor-compressor unit;

said duct having an air inlet at one end within said compartment for receiving air from said forward section and having an outlet for exhausting air from said compartment;

said condenser extending generally horizontally within a substantial portion of said forward section;

means for directing air entering said forward section to be distributed substantially evenly over the surface of said condenser; and a fan positioned at said inlet of said duct;

said motor-compressor unit being positioned in said duct with the compressor portion thereof adjacent said fan;

said fan drawing air over said condenser to said inlet of said duct and directing substantially all of the discharged air over said compressor portion, thereby maximizing heat transferred from the compressor by the flow of air through said compartment.

2. The cooling arrangement as recited in claim 1, wherein said duct further comprises a duct extension surrounding and projecting beyond the fan to reduce fan tip noise.

3. The cooling arrangement as recited in claim 1, wherein said duct comprises:

a portion of the rear wall of said machinery compartment;

a portion of the top wall of said machinery compartment;

a substantially horizontal bottom wall;

and a generally vertical partition positioned generally parallel with said rear wall between said top wall and said bottom wall and extending generally from one side wall of said compartment to an approximate mid-compartment location adjacent said air inlet; and said air inlet being generally vertical and perpendicular to said rear wall.

4. The cooling arrangement as recited in claim 3, wherein said duct further comprises a slab of sealing material disposed against said one side wall of said compartment in sealing engagement with the edge of said generally vertical partition.

5. The cooling arrangement as recited in claim 1, wherein said means for directing air entering said forward section includes a drain pan.

6. The cooling arrangement as recited in claim 5, wherein said means including a drain pan for directing air to be distributed substantially evenly over the surface of the condenser, comprises:

a generally flat rectangular shallow pan supported by said condenser in spaced relation thereto, said pan also acting as a baffle to direct air entering said forward section to flow over said condenser;

a first generally vertical partition positioned at the rear of said condenser generally parallel with the rear wall of said machinery compartment and extending from one side wall of said compartment to an inboard location generally adjacent said inlet of said duct;

said first partition directing air flow transversely across the rear of said condenser; and a second generally vertical partition interposed between said condenser and the other side wall of said machinery compartment;

said second partition directing air to flow over the condenser and preventing air flow from bypassing said condenser;

said first partition, said second partition and said drain pan providing balanced impedance and deflection for causing air which is drawn through said forward section by said fan to be distributed substantially evenly over the surface of the condenser.

7. The cooling arrangement as recited in claim 1, wherein said condenser comprises:

an arrangement of tubing in substantially a single layer, whereby the collection of dust on said condenser is minimized.

* * * * *